US012692631B2

(12) United States Patent
Nakamichi et al.

(10) Patent No.: US 12,692,631 B2
(45) Date of Patent: Jul. 28, 2026

(54) COMPOSITE FIBER, COMPOSITE MIXED-FILAMENT FIBER INCLUDING SAME, WOVEN/KNITTED FABRIC, AND GARMENT

(71) Applicant: Toray Industries, Inc., Tokyo (JP)

(72) Inventors: Shinya Nakamichi, Otsu (JP); Kojiro Inada, Otsu (JP); Tomohiko Matsuura, Shizuoka (JP); Masato Masuda, Shizuoka (JP)

(73) Assignee: Toray Industries, Inc., Tokyo (JP)

( * ) Notice: Subject to any disclaimer, the term of this patent is extended or adjusted under 35 U.S.C. 154(b) by 311 days.

(21) Appl. No.: 18/269,808

(22) PCT Filed: Jan. 7, 2022

(86) PCT No.: PCT/JP2022/000301

§ 371 (c)(1),
(2) Date: Jun. 27, 2023

(87) PCT Pub. No.: WO2022/158310

PCT Pub. Date: Jul. 28, 2022

(65) Prior Publication Data

US 2024/0060217 A1 Feb. 22, 2024

(30) Foreign Application Priority Data

Jan. 25, 2021 (JP) ..... 2021-009281

(51) Int. Cl.
*D01F 8/14* (2006.01)
*D03D 15/283* (2021.01)
*D03D 15/292* (2021.01)

(52) U.S. Cl.
CPC ..... *D01F 8/14* (2013.01); *D03D 15/283* (2021.01); *D03D 15/292* (2021.01); *D10B 2331/04* (2013.01)

(58) Field of Classification Search
None
See application file for complete search history.

(56) References Cited

U.S. PATENT DOCUMENTS 5,366,804 A * 11/1994 Dugan ..... D01F 8/14 525/425
2004/0175542 A1 9/2004 Miyasaka
(Continued)

FOREIGN PATENT DOCUMENTS

CN 86 1 02179 A 11/1986
CN 1537184 A 10/2004
(Continued)

OTHER PUBLICATIONS

Machine Translation of JPH05140867 (Year: 1993).*
(Continued)

*Primary Examiner* — Shawn Mckinnon
(74) *Attorney, Agent, or Firm* — Buchanan Ingersoll & Rooney PC

(57) ABSTRACT

A composite fiber that satisfies properties of both stretchability and wear resistance, and that exhibits a delicate worsted-wool feeling closer to wool, a deep natural appearance, and a satisfactory feeling is described, and a woven/knitted fabric and a garment including the composite fiber, where the composite fiber includes a polyester-based thermoplastic resin A and a polyester-based thermoplastic resin B, and satisfies requirements (1) to (4):

(1) a difference ($M_A$–$M_B$) between a weight average molecular weight $M_A$ of the polyester-based thermoplastic resin A and a weight average molecular weight $M_B$ of the polyester-based thermoplastic resin B is 2,000 to 15,000;

(2) in the composite fiber, an apparent thick/thin ratio ($D_{thick}/D_{thin}$) of the composite fiber is 1.05 to 3.00;

(Continued)

(3) in a cross-section of the composite fiber, the polyester-based thermoplastic resin B covers the thermoplastic resin A, and a ratio ($t_{min}$/D) of a minimum value $t_{min}$ of a thickness t of the thermoplastic resin B to a fiber diameter D of the composite fiber is 0.01 to 0.10; and (4) in the cross-section of the composite fiber, a circumferential length $C_t$ of a portion where the thickness t satisfies $1.00t_{min} \leq t \leq 1.05t_{min}$ is $C_t \geq 0.33$ C with respect to an entire circumferential length C of the composite fiber.

10 Claims, 3 Drawing Sheets

(56) References Cited

U.S. PATENT DOCUMENTS

| | | | | |
|---|---|---|---|---|
| 2011/0287676 | A1 | 11/2011 | Ichikawa et al. | |
| 2020/0087820 | A1* | 3/2020 | Suzuki | D02G 3/045 |

FOREIGN PATENT DOCUMENTS

| | | | | |
|---|---|---|---|---|
| CN | 102308033 | A | | 1/2012 |
| CN | 110088365 | A | | 8/2019 |
| CN | 119452129 | A | | 2/2025 |
| CN | 119452130 | A | | 2/2025 |
| EP | 0 201 114 | A1 | | 12/1986 |
| JP | H05140867 | | * | 6/1993 |
| JP | 09228181 | A | | 9/1997 |
| JP | 2003239153 | A | | 8/2003 |
| JP | 2003328248 | A | | 11/2003 |
| JP | 2004218156 | A | | 8/2004 |
| JP | 2011174215 | A | | 9/2011 |
| JP | 2011208313 | A | | 10/2011 |
| JP | 2012136804 | A | | 7/2012 |
| JP | 2019-214798 | A | | 12/2019 |
| WO | 03093547 | A1 | | 11/2003 |
| WO | 2018110523 | A1 | | 6/2018 |

OTHER PUBLICATIONS

International Search Report and Written Opinion for International Application No. PCT/JP2022/000301, dated Mar. 8, 2022, 5 pages.

Office Action (The First Office Action) issued Mar. 19, 2025, by the State Intellectual Property Office of People's Republic of China in corresponding Chinese Patent Application No. 202280009834.1 and an English translation of the Office Action. (14 pages).

Extended European Search Report issued Dec. 11, 2025, by the European Patent Office in corresponding European Patent Application No. 22742434.8-1102. (7 pages).

* cited by examiner

[Fig. 1]
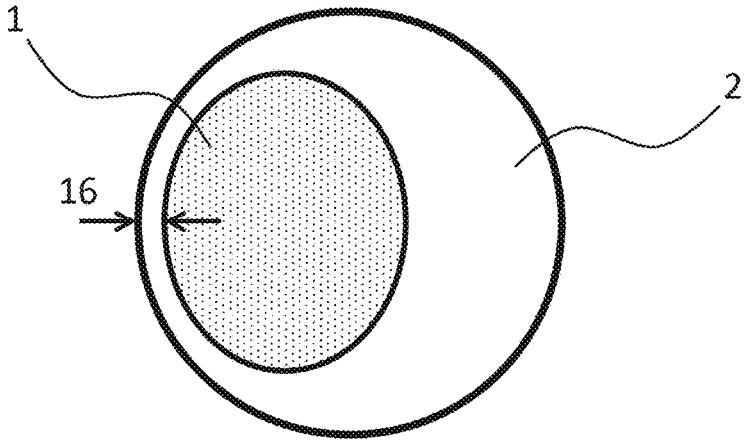
[Fig. 2]
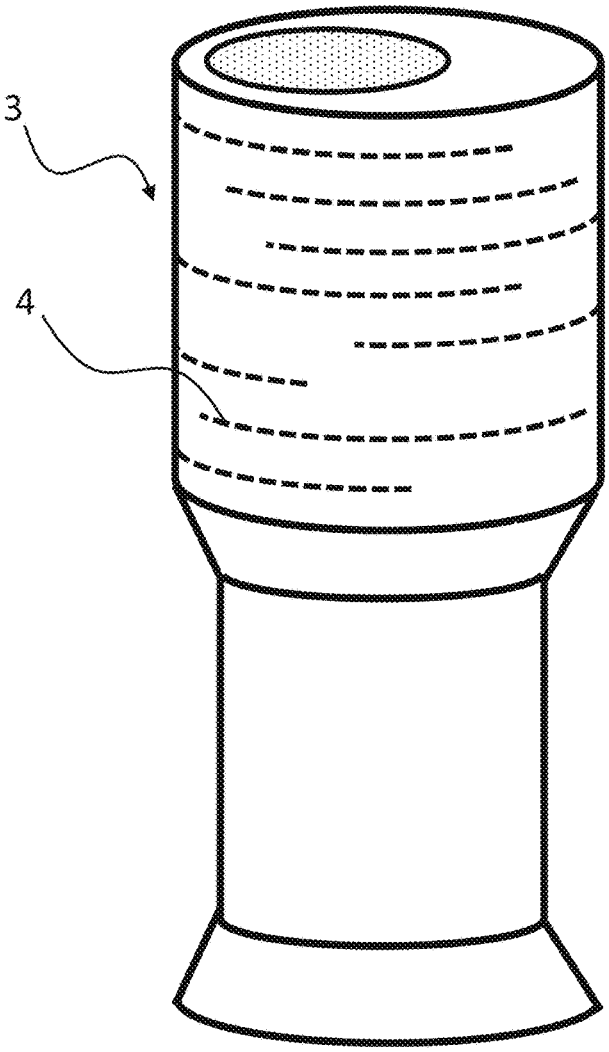

[Fig. 3]
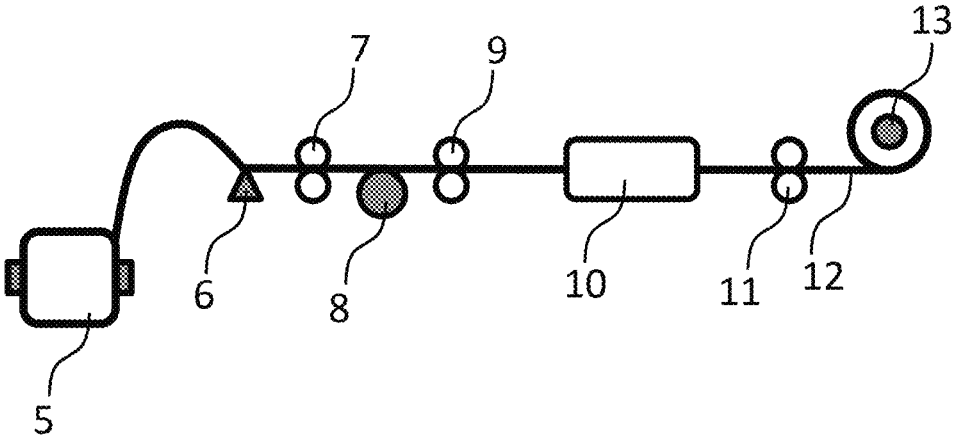
[Fig. 4]
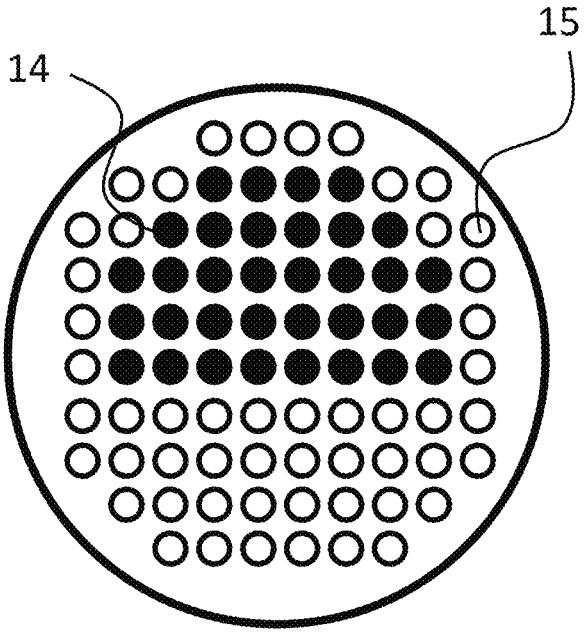

[Fig. 5]
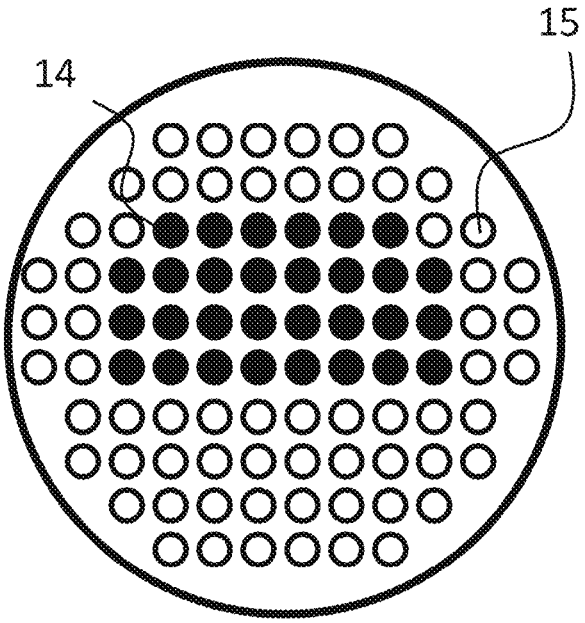

COMPOSITE FIBER, COMPOSITE MIXED-FILAMENT FIBER INCLUDING SAME, WOVEN/KNITTED FABRIC, AND GARMENT

CROSS REFERENCE TO RELATED APPLICATIONS

This application is the U.S. National Phase of PCT/JP2022/000301, filed Jan. 7, 2022, which claims priority to Japanese Patent Application No. 2021-009281, filed Jan. 25, 2021, the disclosures of these applications being incorporated herein by reference in their entireties for all purposes.

FIELD OF THE INVENTION

The present invention relates to a composite fiber, and a woven/knitted fabric and a garment including the same, more particularly, to a composite fiber having a satisfactory feeling such as a delicate worsted-wool feeling and a deep natural appearance, and functionality such as stretchability, and a composite mixed-filament fiber, a woven/knitted fabric, and a garment including the same.

BACKGROUND OF THE INVENTION

Conventionally, there has been a demand for a fabric with a worsted-wool feeling in which a puffy soft texture like a wool material and high resilience such as tenseness and stiffness are reproduced. Especially nowadays, there has been a demand for a fabric that is inhibited from giving a tight sense to a wearer and conforms to movements in a case of using the fabric for a garment or the like, that is, a fabric excellent in stretchability while having an appearance with a worsted-wool feeling equivalent to that of a wool material.

In addition, a woven/knitted fabric obtained from natural fibers such as wool has a large amount of fiber fragments generated during use, washing, and the like. In particular, the fiber fragments falling off from the fibers during washing possibly cause various problems such as an increase in waste, a wastewater treatment load, and a maintenance load of a washing machine.

As a conventional fabric having a worsted-wool feeling, for example, a fabric with a worsted-wool feeling obtained from thick-and-thin-processed composite fibers that imitate scaly tissue (scales) formed on a fiber surface of wool has been proposed as disclosed in Patent Document 1.

By contrast, as a fiber used for a fabric having stretchability, for example, an eccentric core-sheath composite fiber as disclosed in Patent Document 2 is known.

PATENT DOCUMENTS

Patent Document 1: Japanese Patent Laid-open Publication No. 2003-328248

Patent Document 2: International Publication No. 2018/110523

SUMMARY OF THE INVENTION

One of conceivable fiber fall-off inhibiting means is a means of obtaining a fabric with a worsted-wool feeling using filament fibers. However, in a case where a side-by-side composite fiber is used in a technique as disclosed in Patent Document 1, interfacial separation occurs due to friction or impacts to partly cause whitening, which is the phenomenon in which white streaks are formed, and fluffing and the like, resulting in a decrease in fabric appearance quality. Furthermore, cracks are generated during an alkali treatment only on one side of a surface, and thus there is a problem in that a delicate worsted-wool feeling is not sufficiently exhibited. Patent Document 1 also describes a case where a conventional eccentric core-sheath composite fiber is used. However, since a high-shrinkage ingredient is covered by a low-shrinkage ingredient, there is also a problem in that sufficient stretchability is not exhibited as compared with the side-by-side type. That is, it has not been possible to simultaneously satisfy stretchability, wear resistance, and an appearance having a worsted-wool feeling.

In addition, Patent Document 2 discloses an invention relating to a fabric having an excellent even and smooth appearance, which is completely opposite to a grainy feeling or a worsted-wool feeling. Therefore, it is not possible to obtain a grainy feeling like natural wool. In addition, as a means to obtain graininess, a means of mixing a fiber with a component having different dyeability is also disclosed, but this means has a large change in grain pitch by a twisted yarn.

The present invention has been made in view of the above circumstances, and an object of the present invention is to provide a composite fiber that satisfies both properties of stretchability and wear resistance, and exhibits a delicate worsted-wool feeling closer to wool, a deep natural appearance, and a satisfactory feeling, and a composite mixed-filament fiber, a woven/knitted fabric, and a garment including the composite fiber.

A composite fiber of the present invention includes a polyester-based thermoplastic resin A and a polyester-based thermoplastic resin B, and satisfies the following requirements (1) to (4):

(1) a difference ($M_A$–$M_B$) between a weight average molecular weight $M_A$ of the polyester-based thermoplastic resin A and a weight average molecular weight $M_B$ of the polyester-based thermoplastic resin B is 2,000 to 15,000;

(2) in the composite fiber, an apparent thick/thin ratio ($D_{thick}/D_{thin}$) of the composite fiber is 1.05 to 3.00;

(3) in a cross-section of the composite fiber, the polyester-based thermoplastic resin B covers the polyester-based thermoplastic resin A, and a ratio ($t_{min}/D$) of a minimum value $t_{min}$ of a thickness t of the polyester-based thermoplastic resin B to a fiber diameter D of the composite fiber is 0.01 to 0.10; and (4) in the cross-section of the composite fiber, a circumferential length $C_t$ of a portion where the thickness t satisfies $1.00t_{min} \leq t \leq 1.05t_{min}$ is $C_t \geq 0.33$ C with respect to an entire circumferential length C of the composite fiber.

According to a preferred aspect of the composite fiber of the present invention, a hysteresis loss rate during elongation recovery at a maximum load of 0.5 cN/dtex of the composite fiber is 0 to 70%.

According to a preferred aspect of the composite fiber of the present invention, a thin/thick length ratio LR1 (L2/L1) of a thin portion length (L2) to a thick portion length (L1) in a fiber axis direction at a measurement load of 0.00166 cN/dtex of the composite fiber is 0.90 to 1.40, and a ratio (LR2/LR1) of a thin/thick length ratio LR2 at a measurement load of 0.11 cN/dtex to the thin/thick length ratio LR1 at the measurement load of 0.00166 cN/dtex is 1.20 to 2.10.

According to a preferred aspect of the composite fiber of the present invention, the composite fiber has a crack on a surface of the composite fiber at least in a portion where an apparent thickness of the composite fiber has a large fiber diameter ($D_{thick}$).

In addition, in a composite mixed-filament fiber of the present invention, at least another type of filament is further combined with the composite fiber of the present invention.

In addition, a woven/knitted fabric of the present invention includes the composite fiber or the composite mixed-filament fiber at least in a portion.

Furthermore, a garment of the present invention includes the composite fiber or the composite mixed-filament fiber, or the woven/knitted fabric at least in a portion.

According to the present invention, a composite fiber having a puffy soft texture and high resilience such as tenseness and stiffness can be obtained. In particular, the composite fiber of the present invention can be used for a composite mixed-filament fiber or a woven/knitted fabric that is excellent in both properties of stretchability and wear resistance and exhibits a delicate worsted-wool feeling closer to natural wool, a deep natural appearance, and a satisfactory feeling, and a garment such as an item in the field of outerwear worn as a women's or men's garment, e.g., a jacket, a suit, and bottoms.

BRIEF DESCRIPTION OF THE DRAWINGS

FIG. 1 is a cross-sectional view illustrating an existence form of a polyester-based thermoplastic resin A and a polyester-based thermoplastic resin B of a composite fiber of the present invention.

FIG. 2 is a perspective view illustrating one embodiment of a surface of the composite fiber of the present invention.

FIG. 3 is a schematic view of a drawing device used in production of the composite fiber of the present invention.

FIG. 4 is a schematic view of a final distribution plate according to Example 1 of the composite fiber of the present invention.

FIG. 5 is a schematic view of a final distribution plate according to Comparative Example 3 of the composite fiber of the present invention.

DETAILED DESCRIPTION OF EMBODIMENTS OF THE INVENTION

A composite fiber of the present invention includes a polyester-based thermoplastic resin A and a polyester-based thermoplastic resin B, and satisfies following requirements (1) to (4):

(1) a difference ($M_A$–$M_B$) between a weight average molecular weight $M_A$ of the polyester-based thermoplastic resin A and a weight average molecular weight $M_B$ of the polyester-based thermoplastic resin B is 2,000 to 15,000;

(2) in the composite fiber, an apparent thick/thin ratio ($D_{thick}/D_{thin}$) of the composite fiber is 1.05 to 3.00;

(3) in a cross-section of the composite fiber, the polyester-based thermoplastic resin B covers the polyester-based thermoplastic resin A, and a ratio ($t_{min}/D$) of a minimum value $t_{min}$ of a thickness t of the polyester-based thermoplastic resin B to a fiber diameter D of the composite fiber is 0.01 to 0.10; and (4) in the cross-section of the composite fiber, a circumferential length $C_t$ of a portion where the thickness t satisfies $1.00t_{min} \leq t \leq 1.05t_{min}$ is $C_t \geq 0.33$ C with respect to an entire circumferential length C of the composite fiber.

Hereinafter, the present invention will be described in detail, but the present invention is not limited to the scope described below at all as long as the gist thereof is not exceeded.

Polyester-Based Thermoplastic Resin A, Polyester-Based Thermoplastic Resin B The composite fiber of the present invention includes the polyester-based thermoplastic resin A and the polyester-based thermoplastic resin B.

As a specific example of the polyester-based resin to be used for the composite fiber of the present invention, it is preferable to use a polyethylene terephthalate-based resin with a main repeat unit of ethylene terephthalate, a polytrimethylene terephthalate-based resin with a main repeat unit of trimethylene terephthalate, or a polybutylene terephthalate-based resin with a main repeat unit of butylene terephthalate. More preferably, both the polyester-based thermoplastic resin A and the polyester-based thermoplastic resin B have a main repeat unit of ethylene terephthalate.

The polyethylene terephthalate-based resin, the polytrimethylene terephthalate-based resin, and the polybutylene terephthalate-based resin described above may have a small amount (usually less than 30 mol %) of copolymerization components as necessary. It is preferable that the copolymerization components of the polyester-based thermoplastic resin A are 8 mol % or less since a hysteresis loss can be easily set to 70% or less. Furthermore, when the copolymerization components are 8 mol % or less, a molecular orientation in the composite fiber can be maintained even after dyeing processing, so that dimensional stability is improved. In addition, preferably, the copolymerization components are 5 mol % or less in both the polyester-based thermoplastic resin A and the polyester-based thermoplastic resin B, and more preferably, the polyester-based thermoplastic resin A and the polyester-based thermoplastic resin B contain no copolymerization component.

The polyester-based thermoplastic resin A and the polyester-based thermoplastic resin B in the present invention may contain one kind or two or more kinds of a micropore forming agent, a cationic dyeable agent, a coloring inhibitor, a heat stabilizer, a flame retardant, a fluorescent brightener, a delusterant, a colorant, an antistatic agent, a moisture absorbent, an antibacterial agent, inorganic fine particles, and the like as necessary within a range in which the object of the present invention is not impaired.

In the composite fiber of the present invention, the difference ($M_A$–$M_B$, hereinafter may be simply referred to as "difference in weight average molecular weight") between the weight average molecular weight $M_A$ of the polyester-based thermoplastic resin A and the weight average molecular weight $M_B$ of the polyester-based thermoplastic resin B is 2,000 to 15,000. When the difference in weight average molecular weight is 2,000 or more, preferably 5,000 or more, a composite fiber having higher resilience and more excellent stretchability can be obtained. On the other hand, when the difference in weight average molecular weight is 15,000 or less, preferably 13,000 or less, a strength of a raw yarn can be improved, and stable spinning can be performed.

In addition, a value of the weight average molecular weight $M_A$ of the polyester-based thermoplastic resin A is preferably in a range of 20,000 to 28,000, and a value of the weight average molecular weight $M_B$ of the polyester-based thermoplastic resin B is preferably in a range of 12,000 to 20,000. Within these ranges, functionality and durability of the composite fiber are improved, and process stability in spinning the composite fiber is also improved.

The weight average molecular weight in the present invention refers to a value, expressed as an integer value, obtained by preparing a measurement solution in which 2.0 mg of the composite fiber is completely dissolved in 2.5 $cm^3$ of tetrahydrofuran and performing a gel permeation chromatography test using polystyrene as a standard substance. As a gel permeation chromatography (GPC) tester, for example, "TOSO GMHHR-H(S)HT" manufactured by Tosoh Corporation is used.

Composite Fiber

In the composite fiber of the present invention, the polyester-based thermoplastic resin B covers the polyester-based thermoplastic resin A. That is, as schematically illustrated in FIG. 1, the composite fiber has a composite cross-section in which the polyester-based thermoplastic resin A and the polyester-based thermoplastic resin B are present in a state of being substantially joined without being separated in a cross-section substantially perpendicular to a fiber axis of the composite fiber, and the polyester-based thermoplastic resin B covers the polyester-based thermoplastic resin A on a fiber surface. In addition, the composite fiber may be a short fiber or a long fiber, but is preferably a long fiber from the viewpoint of fiber fragments.

At this time, in the cross-section of the composite fiber, the ratio ($t_{min}/D$) of the minimum value $t_{min}$ of the thickness t of the polyester-based thermoplastic resin B covering the polyester-based thermoplastic resin A to the fiber diameter D of the composite fiber is 0.01 to 0.10. If the ratio is less than 0.01, there is a decrease in fabric appearance quality due to fluffing or the like and wear resistance. The ratio is preferably 0.02 or more. In addition, if the ratio exceeds 0.10, it is difficult to obtain a sufficient ability to develop crimpiness and sufficient stretchability. The ratio is preferably 0.08 or less.

In addition, in the cross-section of the composite fiber of the present invention, the circumferential length $C_t$ of the portion where the thickness t satisfies $1.00t_{min} \leq t \leq 1.05t_{min}$ is $C_t \geq 0.33$ C with respect to the entire circumferential length C of the composite fiber. In this way, as compared with a conventional eccentric core-sheath composite fiber having the same ratio of an area ($S_A$) of the polyester-based thermoplastic resin A to an area ($S_B$) of the polyester-based thermoplastic resin B in its cross-section, the centers of gravity of regions where the respective resins exist are apart from each other, so that the obtained crimped fiber can form a finer spiral, and can develop satisfactory crimpiness. Furthermore, in order to obtain crimpiness suitable for a woven/knitted fabric having a worsted-wool feeling, $C_t \geq 0.40$ C is more preferable. In addition, in principle, $C_t < C$, and $C_t \leq 0.70$ C is preferable.

Furthermore, in the composite fiber of the present invention, the apparent thick/thin ratio ($D_{thick}/D_{thin}$) is 1.05 to 3.00. In the present invention, the apparent thick/thin ratio ($D_{thick}/D_{thin}$) refers to a ratio of a fiber diameter ($D_{thick}$) of a portion where a width of a composite fiber bundle in a direction perpendicular to the fiber axis direction is relatively larger than an average value to a fiber diameter ($D_{thin}$) of a portion where the width is relatively smaller than the average value at a load of 0.11 cN/dtex. If the apparent thick/thin ratio ($D_{thick}/D_{thin}$) of the composite fiber of the present invention is less than 1.05, an appearance having a worsted-wool feeling like a natural fiber woven/knitted fabric is not obtained when the composite fiber is formed into a woven/knitted fabric. The ratio is preferably 1.25 or more and more preferably 1.40 or more. In addition, if the ratio exceeds 3.00, the appearance deviates from a natural appearance and does not become a preferable appearance. The ratio is preferably 2.00 or less. Specific measurement methods of the thickness t, the fiber diameter D, the thick/thin ratio, the circumferential length C, and the like are as described in Examples.

In the present invention, by simultaneously satisfying the above-described requirements (1) to (4), it is possible to achieve at once a worsted-wool feeling and a natural appearance, wear resistance that has been a problem in a side-by-side composite fiber, and stretchability that has been a problem in a typical eccentric core-sheath composite fiber.

In addition, the composite fiber is not limited to a particular cross-sectional shape, and cross-sectional shapes such as a circular shape, an elliptical shape, and a triangular shape can be adopted. The circular shape is more preferable because the composite fiber satisfying the requirements (1) to (4) can be stably spun.

In the composite fiber of the present invention, when a ratio $S_A$:$S_B$ of the area ($S_A$) of the polyester-based thermoplastic resin A to the area ($S_B$) of the polyester-based thermoplastic resin B in the cross-section is preferably 70:30 to 30:70, more preferably 60:40 to 40:60, physical properties are improved. In addition, in order to make the crimpiness of the composite fiber finer, $S_A > S_B$ is further preferable.

Next, in the composite fiber of the present invention, a hysteresis loss rate during elongation recovery at a maximum load of 0.5 cN/dtex of the composite fiber is preferably 0 to 70%, more preferably 40 to 70%. It is preferable that the hysteresis loss rate is 70% or less because a garment made of a woven/knitted fabric using the composite fiber of the present invention has sufficient recoverability even when elongated in accordance with movements of a body, and strain of the garment is small. In addition, it is more preferable that the hysteresis loss is 40% or more because the elongated garment does not excessively tighten the body. The hysteresis loss rate is 0% or more in terms of the measurement method.

In the composite fiber of the present invention, a thin/thick length ratio LR1 (L2/L1) of a thin portion length (L2) to a thick portion length (L1) in the fiber axis direction at a measurement load of 0.00166 cN/dtex (1.5 mg/Denier) of the composite fiber is preferably 0.90 to 1.40. By setting the measurement load to 0.00166 cN/dtex (1.5 mg/Denier), sagging mainly in measuring the composite fiber of the present invention can be removed. In the composite fiber of the present invention, the thin portion the orientation of which is usually relatively advanced has a light color, and the thick portion the orientation of which is not advanced has a dark color by dyeing processing. By setting LR1 to 0.90 to 1.40, it is possible to obtain a more excellent light-and-dark grainy appearance with a worsted-wool feeling when a woven/knitted fabric is dyed. When LR1 is increased, the number of light-colored portions can be increased, and when LR1 is decreased, the number of dark-colored portions can be increased. The worsted-wool feeling can be emphasized when there are slightly more light colors than dark colors, and thus LR1 is more preferably 1.00 or more, still more preferably 1.10 or more.

However, in order to obtain a more excellent worsted-wool feeling in the composite fiber having stretchability, in addition to LR1 being 0.90 to 1.40 as described above, a ratio (LR2/LR1) of a thin/thick length ratio LR2 at a measurement load of 0.11 cN/dtex (0.10 g/Denier) to the thin/thick length ratio LR1 at the measurement load of 0.00166 cN/dtex (1.5 mg/Denier) is preferably 1.20 to 2.10. Here, LR2 is a ratio (L4/L3) of a thin portion length (L4) to a thick portion length (L3) in the fiber axis direction at the measurement load of 0.11 cN/dtex of the composite fiber. A woven/knitted fabric with a worsted-wool feeling such as a wool woven/knitted fabric does not have stretchability in use, and thus has little change in appearance. By contrast, a fabric having stretchability and a worsted-wool feeling has a poor appearance in use in some cases. According to the study of the present inventors, it has been found that the reason is a change in appearance due to stretching. By adopting the above-described range of the present invention, it is possible to inhibit an excessive balance change in light-and-dark grainy appearance when a woven/knitted fabric is elongated, and to impart a natural appearance. The reason why the measurement load is 0.11 cN/dtex (0.10 g/Denier) is to cope with stress assuming a state in which, for example, a garment made of a woven/knitted fabric using the composite fiber of the present invention is elongated in accordance with movements of a body. The composite fiber of the present invention develops coiled crimpiness due to a shrinkage difference between the polyester-based thermoplastic resin A and the polyester-based thermoplastic resin B by heat treatment in dyeing processing. This crimpiness is actively developed in the thin portion having a large structural difference. Furthermore, when LR2/LR1 is 1.20 to 2.10, the crimpiness of the thin portion is elongated, and more excellent stretchability is obtained. When LR2/LR1 is 1.20 or more, more preferably 1.30 or more, still more preferably 1.40 or more, excellent stretchability is obtained, and when LR2/LR1 is 2.10 or less, more preferably 2.00 or less, still more preferably 1.90 or less, a thin portion ratio at the time of elongation is maintained, and an excellent light-and-dark grainy appearance with a worsted-wool feeling is obtained. Note that values measured by methods described in Examples are used as the values of the thick portion length and the thin portion length.

Next, the composite fiber of the present invention preferably has a crack on a surface of the composite fiber at least in a portion where an apparent thickness of the composite fiber has a large fiber diameter ($D_{thick}$). More preferably, the crack is formed in a direction substantially perpendicular to a longitudinal direction of the composite fiber. Still more preferably, the crack in the direction substantially perpendicular to the composite fiber is formed such that their depth changes in a fiber circumferential length direction. In addition, the depth of the crack is preferably 0.5 to 5.0 μm. In this way, a woven/knitted fabric using the composite fiber can have a more delicate worsted-wool feeling and a deep natural appearance.

Here, the depth of the crack is measured at the deepest points of the crack. In addition, the direction substantially perpendicular to the longitudinal direction of the composite fiber means that the crack is formed along the circumference substantially perpendicular to the longitudinal direction of the composite fiber as schematically illustrated in FIG. 2. Such cracks are not limited to a particular length in the circumferential direction of the composite fiber, but it is more preferable that the length is ½ or more of the length of the outer circumference of the composite fiber because when the composite fiber is formed into a woven/knitted fabric, an appearance having a natural worsted-wool feeling as in the case of using natural fibers can be obtained. In the present invention, as the depth and length of the crack, average values obtained by observing the crack using an electron microscope and measuring 10 cracks in one composite fiber are used. A specific measurement method is as described in Examples.

An average fiber diameter $D_{ave}$ of the composite fiber in the present invention is preferably 10 μm to 30 μm. Within this range, tenseness, stiffness, and stretchability when the composite fiber is formed into a woven/knitted fabric, and a soft touch closer to a natural wool material can be obtained. In the present invention, the average fiber diameter $D_{ave}$ is a value calculated from the fineness of the composite fiber.

In addition, the composite fiber of the present invention is also preferably in the form of a flat yarn, a crimped yarn, an air-jetted yarn, an air-interlaced yarn, a twisted yarn, or the like according to a desired purpose.

Composite Mixed-Filament Fiber, Woven/Knitted Fabric, and Garment Including Composite Fiber In a composite mixed-filament fiber of the present invention, at least another type of filament is further combined with the composite fiber of the present invention. In addition, a woven/knitted fabric of the present invention includes the composite fiber and/or the composite mixed-filament fiber of the present invention at least in a portion. In this way, as described above, it is possible to obtain an appearance having a natural worsted-wool feeling as in the case of using natural fibers. In addition, in the woven/knitted fabric of the present invention, although the woven/knitted fabric can be obtained only from the composite fibers or the composite mixed-filament fibers, it is preferable to form the woven/knitted fabric in the form of mixed-filament yarns with another filament, composite false-twisted yarns, plied yarns, or the like from the viewpoint of obtaining a more natural worsted-wool feeling and a more natural grainy feeling. In the present invention, the other filament is not particularly limited as long as it is different from the composite fiber of the present invention, but in particular, the filament is preferably constituted of a polyester-based resin because of satisfactory crimpiness and mechanical properties and excellent dimensional stability against humidity and temperature changes. As a specific example of the polyester-based resin, it is preferable to use a polyethylene terephthalate-based resin with a main repeat unit of ethylene terephthalate, a polytrimethylene terephthalate-based resin with a main repeat unit of trimethylene terephthalate, or a polybutylene terephthalate-based resin with a main repeat unit of butylene terephthalate. The polyethylene terephthalate-based resin or the polybutylene terephthalate-based resin described above may have a small amount (usually less than 30 mol %) of copolymerization components as necessary.

In addition, it is preferable that the other filament combined with the composite fiber of the present invention has a difference in fiber length from the composite fiber of the present invention after dyeing processing because puffiness becomes more excellent. In order to obtain the difference in fiber length, a method of physically adjusting a supply amount of each fiber at the time of combining, a method of mixing a fiber having lower shrinkage properties than the composite fiber of the present invention, and combining by false twisting can be mentioned. The difference in fiber length is preferably 10% or more with which the puffiness can be easily realized, and is preferably 30% or less in consideration of the physical properties of the woven/knitted fabric. A specific method for measuring the difference in fiber length is as described in Examples.

Furthermore, it is more preferable that an apparent thick/thin ratio ($D_{thick}/D_{thin}$) of the other filament mixed with the composite fiber of the present invention is 1.05 to 3.00 because it is possible to express grain differing in phase from the thick/thin ratio of the composite fiber of the present invention and achieve a more natural worsted-wool feeling.

In the woven/knitted fabric of the present invention, a usage rate of the composite fiber and/or the composite mixed-filament fiber of the present invention is preferably 30 mass % or more, more preferably 40 mass % or more, with respect to the mass of the woven/knitted fabric. In another preferable aspect, all the fibers constituting the woven/knitted fabric are the composite fibers and/or the composite mixed-filament fibers of the present invention.

The woven/knitted fabric of the present invention has a fabric structure as a woven fabric or a knitted fabric. A woven texture is selected from plain weave, twill weave, satin weave, and derivative weave thereof according to texture and design properties. Furthermore, a multiple weave structure such as double weave may be employed. A knitted texture may be selected according to desired texture and design properties, and examples of weft knitting include Jersey stitch, rubber stitch, pearl stitch, tuck stitch, float stitch, lace stitch, and derivative stitch thereof, and examples of warp knitting include single denbigh stitch, single van dyke stick, single cord stitch, Berlin stitch, double dembigh stitch, atlas stitch, cord stitch, half tricot stitch, satin stitch, sharkskin stitch, and derivative stitch thereof. Among them, it is more preferable to use a relatively simple woven/knitted structure such as plain weave or derivative weave thereof, twill weave or derivative weave thereof, and satin weave in order to have a delicate worsted-wool feeling and a deep natural appearance.

A garment of the present invention includes the composite fiber or the composite mixed-filament fiber, or the woven/knitted fabric of the present invention at least in a portion. In this way, it is possible to obtain a garment that exhibits a delicate worsted-wool feeling close to natural wool, a deep natural appearance, and a satisfactory feeling, which are possessed by the composite fiber or the composite mixed-filament fiber, or the woven/knitted fabric of the present invention. The garment of the present invention includes an item in the field of outerwear worn as a women's or men's garment, particularly a jacket, a suit, bottoms, and a part thereof, e.g., a front main panel, a back main panel, a collar, a sleeve, a chest pocket, and a side pocket.

In addition, the garment of the present invention is preferably subjected to a post-treatment of any of washing, air blowing, and air suction after sewing. Therefore, fiber fragments attached to a cut portion of a fabric and a fabric surface can fall off in advance, and the amount of fiber fragments generated during washing or the like can be further reduced.

In the woven/knitted fabric or the garment of the present invention, the fiber fragments generated during washing can be collected and evaluated using a collecting bag (filter) attached to a drain hose of a washing machine by performing a washing test of the woven/knitted fabric or the garment. In a case where there is an influence of fiber fragments or the like by washing performed before the evaluation, the washing machine is cleaned in advance. Although the cleaning method is not particularly limited, there is a method of cleaning the washing machine, for example, by performing washing according to ISO 6330 (2012) without putting an object to be washed or a detergent in the washing machine. The washing machine is cleaned by performing rinsing and dehydrating steps once or more each without putting an object to be washed and a detergent. The same conditions are set as washing conditions to be evaluated.

At this time, a C-type standard washing machine defined in ISO 6330 (2012) is used as the washing machine. In addition, washing is performed by 4N method of the C-type standard washing machine defined in ISO 6330 (2012). Fiber fragments discharged from a washing machine drain port are collected by attaching a collector to a drain hose of the washing machine. In this evaluation, a "nylon screen" NY10-HC (purchased from FLON INDUSTRY, catalog value: a sieve opening of 10 μm) is used. In a case where the "nylon screen" NY10-HC (purchased from FLON INDUSTRY, catalog value: a sieve opening of 10 μm) is difficult to obtain, an equivalent product is used within a range of a sieve opening of 10 μm±2 μm.

In the method for evaluating the amount of fiber fragments generated during washing of the woven/knitted fabric or the garment, one fibrous product to be evaluated is put in the washing machine in a state where the collector is attached, and the fibrous product is washed by the washing machine and washing conditions described above. However, a detergent and a loading fabric are not used. After washing, the weight of the fiber fragments attached to the collector is measured. One fibrous product refers to one fibrous product regardless of a shape, size, and weight.

The fiber fragments collected by the collector are subjected to suction filtration using a filter whose weight is measured after absolute drying in advance. In this evaluation, a polycarbonate membrane (K040A047A manufactured by Advantec Toyo Kaisha, Ltd.) is used. The filter and the fiber fragments after filtration are dried at 105° C. for 1 hour, the weight is measured, and a difference from the weight before filtration is taken as the amount of fiber fragments. As for conditions of the absolute drying and weight measurement, heating is performed at 105° C. for 1 hour, and then, the weight is measured after the temperature and humidity are controlled to 20° C. and 65% RH, respectively.

In the woven/knitted fabric and the garment of the present invention, it is possible to achieve 150 (mg/one fibrous product) or less as the amount of fiber fragments collected after this test. In a preferred aspect, it is also possible to achieve 100 (mg/one fibrous product) or less.

Method for Producing Composite Fiber and Woven/Knitted Fabric

Next, an example of a preferred method for producing the composite fiber, the composite mixed-filament fiber, and the woven/knitted fabric of the present invention will be described.

The composite fiber of the present invention can be produced by a thick-and-thin (Thick&Thin) drawing step after winding an ejected thermoplastic resin as an undrawn yarn (UY) or a partially oriented yarn (POY). In particular, the composite fiber obtained by the step of winding and then drawing the POY is preferable because the composite fiber is particularly excellent in stretchability when formed into the woven/knitted fabric and dyed because of an orientation difference between the polyester-based thermoplastic resin A and the polyester-based thermoplastic resin B, and is also excellent in resistance to embrittlement due to alkali weight reduction because of an increase in orientation of the polyester resin A.

Spinning Step

In the method for producing the composite fiber of the present invention, first, the polyester-based thermoplastic resin A and the polyester-based thermoplastic resin B are individually melted, and ejected from a spinneret, and wound up as the UY or the POY at a spinning speed of preferably 1400 m/min to 3800 m/min.

In the present invention, it is preferable to form the composite textured yarn of the present invention from the POY since the hysteresis loss can be easily set to 70% or less. Since the POY is more crystallized than the UY, plastic deformation due to load application can be inhibited.

A spinning temperature is preferably 20° C. to 50° C. higher than melting points ($T_{mA}$, $T_{mB}$) of the polyester-based thermoplastic resin A and the polyester-based thermoplastic resin B. When the temperature is 20° C. or more higher than ($T_{mA}$, $T_{mB}$), it is possible to prevent the melted polyester-based thermoplastic resin A and polyester-based thermoplastic resin B from solidifying in pipelines of a spinning machine and clogging the pipelines. On the other hand, when the temperature is 50° C. or less higher than ($T_{mA}$, $T_{mB}$), it is possible to inhibit thermal deterioration of the melted polyester-based thermoplastic resin A and polyester-based thermoplastic resin B.

The spinneret used in the method for producing the composite fiber of the present invention may have any of common internal structures so long as the spinneret renders stable spinning with respect to quality and operation.

Here, in the composite fiber of the present invention, the polyester-based thermoplastic resin A is completely covered by the polyester-based thermoplastic resin B in the cross-section of the composite fiber as described above. By forming such a cross-section of the composite fiber, it is also possible to inhibit ejected-filament bending occurring due to a difference in flow rate between the two types of thermoplastic resins ejected from the spinneret, which has been a problem in production of the composite fiber.

In the composite fiber of the present invention, it is preferable to precisely control the minimum value $t_{min}$ of the thickness t of the polyester-based thermoplastic resin B covering the polyester-based thermoplastic resin A and the circumferential length $C_t$ of the portion where the thickness t in the cross-section of the composite fiber satisfies $1.00t_{min} \leq t \leq 1.05t_{min}$ as described above, and a spinning method using distribution plates as exemplified in Japanese Patent Laid-open Publication No. 2011-174215, Japanese Patent Laid-open Publication No. 2011-208313, and Japanese Patent Laid-open Publication No. 2012-136804 is suitably used. By using such distribution plates, $t_{min}$ can be set within the above-described range, exposure of the polyester-based thermoplastic resin A generated as a result of an excessive decrease in $t_{min}$ can be inhibited, and whitening and fluffing of the woven/knitted fabric can be further inhibited. Also, an excessive increase in $t_{min}$ can be inhibited, and the crimpiness of the composite fiber can be developed in a suitable range to improve the stretchability of the woven/knitted fabric. In the method using such distribution plates, a cross-sectional form of single filaments can be controlled by disposition of distribution holes in a final distribution plate installed most downstream among the plurality of distribution plates.

Drawing Step

Next, the yarn produced through the above-described spinning step is drawn using a drawing device as illustrated in FIG. 3 at a draw ratio within a range not exceeding a natural draw ratio of the yarn to form a drawn yarn (DY). By this step, a desired thick-and-thin yarn (thick-and-thin yarn) can be obtained. For example, the POY obtained by composite spinning at a spinning speed of 2600 m/min can be pin-drawn at a draw ratio of 1.5 times, a hot pin temperature of 70° C., a set temperature of 150° C., and a yarn speed of 300 m/min to obtain a yarn having an apparent thick/thin ratio of 1.05 or more and 3.00 or less. In addition, it is preferable to perform drawing in a range of a lower limit× 1.2 times to an upper limit×0.8 times of the natural draw ratio. By forming the composite fiber drawn within the above range, it is easy to adjust the ratio (LR2/LR1) of the thin/thick length ratio LR2 under application of the load of 0.11 cN/dtex to the thin/thick length ratio LR1 of the composite fiber described above at a dyeing step and the like to be described later to fall within the range of the present invention. In a case where thermal shrinkage after the drawing step greatly adversely affects the subsequent steps, it is desirable to perform some thermal setting after the drawing step in order to inhibit the thermal shrinkage. In addition, it is also preferable to perform false twisting by a conventional method at this time. This DY can also be used as the composite fiber of the present invention.

In addition, before or after winding the drawn composite fiber, another filament may be combined by mixing or the like to form the composite mixed-filament fiber. The mixing method is not particularly limited, and typical methods such as interlaced fiber mixing and Taslan fiber mixing have no problem, and thermal setting, false twisting, and twisted yarn processing can also be performed after fiber mixing.

Step of Forming Woven/Knitted Fabric

The composite fiber obtained at the drawing step is formed into the woven fabric or the knitted fabric. In the case of the woven fabric, weaving is performed using an air-jet loom, a water-jet loom, a rapier loom, a projectile loom, a shuttle loom, or the like. In the case of the knitted fabric, knitting is performed using a weft knitting machine such as a flat knitting machine, a full fashion knitting machine, a circular knitting machine, a computer jacquard knitting machine, a socks knitting machine, and a cylindrical knitting machine, or a warp knitting machine such as a tricot knitting machine, a raschel knitting machine, an air-jet loom, and a milanese knitting machine.

Alkali Weight Reduction Step

Furthermore, the woven/knitted fabric obtained at the above-described step of forming the woven/knitted fabric is subjected to an alkali weight reduction treatment as necessary so that an alkali weight reduction rate is 5% or more, more preferably 10 to 15%. Through this step, the entire surface of the above-described composite fiber can have cracks. In addition, a continuous weight reduction process is preferable in order to avoid embrittlement due to selective weight reduction.

Dyeing Step

Furthermore, if necessary, before and/or after the above-described alkali weight reduction step, or simultaneously, conventional scouring, relaxation treatment, intermediate thermal setting, dyeing processing, and finishing thermal setting may be performed (in the present invention, these processes may be collectively referred to as "dyeing step"). In order to obtain the ratio (LR2/LR1) of the thin/thick length ratio LR2 under application of the load of 0.11 cN/dtex to the thin/thick length ratio LR1 of the composite fiber, which is a preferred aspect of the present invention, feed and tension management is appropriately performed at each step. For example, in the composite fiber axis direction of the present invention, it is desirable to control a liquid amount and a flow rate so that overfeed is within 10% in a facility of, for example, a roll-to-roll system capable of controlling with a feed amount and an excessive tension is not applied to a travel direction in a batch-type jet dyeing machine or the like. Dyeing is preferably performed in a dyeing solution at 110 to 130° C. using a disperse dye or a cationic dye, though depending on the dyeability of the thermoplastic resins constituting the composite fiber or another filament to be combined.

EXAMPLES

Next, the present invention will be described in detail on the basis of the Examples. However, the present invention is not limited only to these Examples. Unless otherwise described, physical properties are measured on the basis of the methods described above.

Measurement Methods (1) Measurement of Weight Average Molecular Weight of Thermoplastic Resin As a gel permeation chromatography (GPC) tester, "TOSO GMHHR-H(S)HT" manufactured by Tosoh Corporation was used.

(2) Measurement of Average Fiber Diameter $D_{ave}$

The composite fiber was taken out from the woven/knitted fabric after the dyeing processing, and the fineness and the number of filaments were measured in accordance with JIS L1013 (2010) 8.3.1, method B and JIS L1013 (2010) 8.4, respectively, to obtain a single-filament fineness by the fineness/the number of filaments. From the obtained single-filament fineness, an average fiber diameter was calculated by the following formula.

[Mathematical formula 1]

$$\text{Dave}(\mu\text{m}) = \sqrt{\frac{\text{Single-filament fineness}}{10000 \times \pi \times \rho} \times 10^6 \times 2}$$

$\rho$: density $(g/m^3)$ $1.38 \times 10^6$ $g/m^3$ in the case of polyethylene terephthalate.

(3) Measurement of Fiber Diameter D, Thickness t of Polyester-Based Thermoplastic Resin B Covering Polyester-Based Thermoplastic Resin A, and Circumferential Length C of Fiber A multifilament including composite fibers, embedded in an embedding material such as an epoxy resin continuously at 10 locations at intervals of 1 cm in the fiber axis direction was used as a sample, and each sample was photographed with a transmission electron microscope (TEM) to obtain an image thereof at such a magnification that 10 or more fibers can be observed. At this time, metal dyeing was performed to render the contrast of a joint portion between the polyester-based thermoplastic resin A and the polyester-based thermoplastic resin B clear. By using "WinROOF 2015" manufactured by Mitani Corporation as image analysis software, the fiber diameter D was measured from all the single filaments in the observation image, and the circumferential length C and the thickness t of the polyester-based thermoplastic resin B were individually measured therefrom. The fiber diameter D, the circumferential length C, and the thickness t of the present invention were obtained by preparing and averaging 10 sets of the obtained fiber diameters D, circumferential lengths C, and thicknesses t, and determining the fiber diameter D to three significant figures and the circumferential length C and the thickness t to two significant figures.

(4) Hysteresis Loss Rate

The composite fiber was taken out from the woven/knitted fabric after the dyeing step (finishing thermal setting), and in accordance with constant-speed elongation conditions described in JIS L1013 (2010) 8.5.1 normal-state test, the composite fiber was elongated from an initial load of 0.1 cN/dtex to a maximum stress of 0.5 cN/dtex at a sample length of 20 cm and a tensile speed of 20 cm/min by a Tensilon tensile tester, and then recovered to the position of an origin sample length at the same speed. A hysteresis curve was described with the elongation as the horizontal axis and the stress as the vertical axis, and from an area (A1) surrounded by the curve at the time of elongation, the curve at the time of recovery, and the horizontal axis and an area (A2) surrounded by the curve at the time of elongation, a straight line described perpendicularly from an end point thereof to the horizontal axis, and the horizontal axis (elongation axis), the hysteresis loss was obtained by the following equation. The hysteresis loss rate was obtained by rounding off the second decimal place to one decimal place.

$$\text{Hysteresis loss (\%)} = (A1/A2) \times 100.$$

(5) Measurement of Apparent Thick/Thin Ratio ($D_{thick}/D_{thin}$)

The composite fiber is taken out from the woven/knitted fabric after the dyeing step (finishing thermal setting), and both ends of the composite fiber are fixed in a state where a load of 0.11 cN/dtex is applied. In an image obtained by photographing a side surface of the fixed sample with a digital microscope "VHX 2000" manufactured by Keyence Corporation at a magnification of 200 times, the diameter of a fiber bundle is continuously measured at 500 locations at intervals of 1.0 mm in the fiber axis direction. The fiber diameter ($D_{thick}$) of the thick portion and the fiber diameter ($D_{thin}$) of the thin portion were determined by defining a portion thinner than an average value of all the measurement data as the thin portion and defining a portion thicker than the average value of all the measurement data as the thick portion. A boundary of the thick portion from the thin portion was defined as the third point where 3 points thicker than the thin portion by 1.05 times or more were continuous, and a boundary of the thin portion from the thick portion was defined as the third point where 3 points thicker than the thin portion by 1.05 times or less were continuous. The apparent thick/thin ratio was obtained by rounding off the third decimal place to two decimal places.

(6) Measurement of Thick Portion Length ($L_{thick}$) and Thin Portion Length ($L_{thin}$) in Fiber Axis Direction The composite fiber is taken out from the woven/knitted fabric after the dyeing step (finishing thermal setting), and both ends of the composite fiber are fixed in a state where a predetermined load is applied. In an image obtained by photographing a side surface of the fixed sample with a digital microscope "VHX 2000" manufactured by Keyence Corporation at a magnification of 200 times, the diameter of a fiber bundle is continuously measured at intervals of 1.0 mm, the thick portion length and the thin portion length alternately present in the fiber axis direction are continuously measured at 50 locations each, the measurement direction is reversed at the time when the measurement is performed at 50 locations each, the same portion is continuously measured at 50 locations for the thick portion and thin portion lengths in the same manner, and averages thereof at 100 locations are defined as $L_{thick}$ and $L_{thin}$. The determination of the thick portion and the thin portion was made in accordance with the above (5). The measurement result was obtained by rounding off the third decimal place to two decimal places.

(7) Measurement of Presence or Absence and Depth of Crack

A portion recognized as the thick portion in the above (5) was observed using a scanning electron microscope "S-3400N" manufactured by Hitachi, Ltd. as an electron microscope. The composite fiber was pulled out from the woven/knitted fabric after the finishing thermal setting without applying an external force, and the presence or absence of a crack was confirmed. In the case of the presence of a crack, a side surface in a direction substantially perpendicular to the crack was observed at a magnification of 2,000 times. The largest depths and lengths of the crack were measured, and an average value obtained by measuring 10 cracks in one composite fiber was defined as the crack depth.

(8) Difference in Fiber Length

A yarn having a length of about 5 cm was taken out from the woven/knitted fabric after the finishing thermal setting in which humidity was controlled in an environment of 20° C. and 65 RH % for 24 hours or more, and carefully divided into single filaments one by one so that the fibers themselves did not stretch. The divided single filaments were placed on a scale plate coated with glycerin, and the fiber lengths were measured under application of a load of 0.11 cN/dtex, and were calculated by the following equation, where the average length of a single filament group having a relatively short fiber length was La, and the average length of a single filament group having a relatively long fiber length was Lb. All the single filaments constituting the composite mixed-filament fiber are classified into any of the single filament groups according to the fiber length. The test is performed 20 times, and an average value thereof is rounded off to one decimal place according to Rule B (rounding method) of JIS Z 8401 (2019).

$$\text{Difference in fiber length (\%)} = \{(Lb - La)/La\} \times 100.$$

(9) Stretchability of Woven/Knitted Fabric Using Composite Fiber and Composite Mixed-Filament Fiber An elongation rate in a direction along the composite fiber of the present invention was measured in accordance with JIS L1096 (2010) 8.16.1, method B. In a case where the composite fiber of the present invention was used for both the warp and the weft, the elongation rate of each of the warp and the weft was measured, and an average value thereof was used as the result.

(10) Evaluation of Texture, Worsted-Wool Feeling, and Grainy Feeling of Woven/Knitted Fabric Using Composite Fiber and Composite Mixed-Filament Fiber Samples of the woven/knitted fabric formed using the composite fiber in the present invention were subjected to sensory evaluation in five stages of very good (5 points), good (4 points), normal (3 points), not very good (2 points), and bad (1 point) by using 10 healthy adults (5 men and 5 women) as evaluators to evaluate a texture (particularly, a puffy feeling and a touch of the surface) of the woven/knitted fabric by a touch and to evaluate a worsted-wool feeling and a grainy feeling visually, and an average value of the inspectors was rounded off to perform evaluation.

(11) Amount of Fiber Fragments of Fibrous Product

By using a C-type standard washing machine described in ISO 6330 (2012), "AQW-V 700E 7 kg" (manufactured by AQUA Co., Ltd.) was used by C4N method of ISO 6330 (2012), and rinse and drain were performed twice without putting an object to be washed. Specifically, a course was carefully set, an amount of water was set to 40 L, a washing time was set to 15 minutes, rinse was set to two times, dehydration was set to 7 minutes, a washing water temperature was set to 40° C., and a rinsing water temperature was set to room temperature. Next, a collecting bag produced using a "nylon screen NY10-HC" (manufactured by FLON INDUSTRY, catalog value: a sieve opening of 10 μm) with a sieve opening of 11.3 μm was attached to a drain hose of the washing machine. Thereafter, one fibrous product to be evaluated was put in the washing machine, and washing was performed under washing conditions of C4N method of ISO 6330. However, a detergent and a loading fabric were not used. After the washing, fiber fragments attached to the "nylon screen" was subjected to suction filtration using a polycarbonate membrane ("K040A047A" manufactured by Advantec Toyo Kaisha, Ltd.) whose weight was measured in advance. The polycarbonate membrane and the fiber fragments after filtration were dried at 105° C. for 1 hour, the weight was measured, and a difference from the weight before filtration was taken as the amount of fiber fragments generated. The weight was obtained by rounding off the third decimal place to two decimal places.

Example 1

Polyethylene terephthalate having a weight average molecular weight of 25,000 was used as the polyester-based thermoplastic resin A, polyethylene terephthalate having a weight average molecular weight of 15,000 was used as the polyester-based thermoplastic resin B, and the polyester-based thermoplastic resin A and the polyester-based thermoplastic resin B were caused to flow into a composite fiber spinneret having 12 ejection holes so as to have a mass composition ratio of 50:50 at a spinning temperature of 290° C. In spinning of this Example 1, distribution holes in a final distribution plate installed most downstream among a plurality of distribution plates are disposed in a shape shown in FIG. 4, so that an eccentric core-sheath (FIG. 1) composite cross-section is formed in which the polyester-based thermoplastic resin A and the polyester-based thermoplastic resin B have a mass composition ratio of 50:50 and the polyester-based thermoplastic resin A is included in the polyester-based thermoplastic resin B. Filaments ejected from the spinneret were cooled by an air-cooling device, oiled, and wound up with a winder at a speed of 2600 m/min, to be stably wound up as a POY having a total fineness of 100 dtex and 12 single filaments.

Subsequently, the obtained POY was fed to a drawing device at a speed of 300 m/min, and subjected to pin drawing at a draw ratio of 1.50 times, a hot pin temperature of 70° C., and a set temperature of 150° C. using the drawing device as shown in FIG. 3 to obtain a DY having an apparent thick/thin ratio ($D_{thick}/D_{thin}$) of 1.40. For this DY, the above-described ($t_{thin}/D$) was 0.020, and the relationship between $C_t$ and C was $C_t$=0.40 C ($C_t$/C=0.40). In addition, $S_A$:$S_B$=50:50.

Next, a yarn obtained by twisting the obtained DY to impart 1200 T/m by a conventional method was used as the warp and the weft, and a ⅓ twill woven fabric having a warp density of 115 yarns/2.54 cm and a weft density of 105 yarns/2.54 cm was produced.

The woven fabric was further subjected to scouring, intermediate thermal setting, and alkali weight reduction (reduction rate: 10%). Thereafter, as the dyeing step, dyeing was performed at a concentration of 1.0 owf % and a temperature of 130° C. for 30 minutes using a disperse dye "Dystar Navy BlueS-GL", and finishing thermal setting was performed at 160° C. The results are shown in Table 1.

Example 2

A composite fiber and a woven fabric were obtained in the same manner as in Example 1 except that a DY having an apparent thick/thin ratio ($D_{thick}/D_{thin}$) of 1.25 was obtained at a draw ratio of 1.30 times in the drawing device at the drawing step. The results are shown in Table 1.

Example 3

A composite fiber and a woven fabric were obtained in the same manner as in Example 1 except that a DY having an apparent thick/thin ratio ($D_{thick}/D_{thin}$) of 1.30 was obtained at a draw ratio of 1.40 times in the drawing device at the drawing step. The results are shown in Table 1.

Comparative Example 1

A composite fiber and a woven fabric were obtained in the same manner as in Example 1 except that polyethylene terephthalate having a weight average molecular weight of 15,000 was used for both the polyester-based thermoplastic resin A and the polyester-based thermoplastic resin B. The results are shown in Table 1.

Comparative Example 2

A composite fiber and a woven fabric were obtained in the same manner as in Example 1 except that the spinneret used in Example 1, which was the spinneret of the distribution plate type, was replaced with a spinneret of the type described in Japanese Patent Laid-open Publication No. H09-157941, to obtain a side-by-side composite fiber constituted of the polyester-based thermoplastic resin A and the polyester-based thermoplastic resin B. The obtained woven fabric had poor quality, and was poor in texture, worsted-wool feeling, and grainy feeling. The results are shown in Table 1.

Comparative Example 3

A composite fiber and a woven fabric were obtained in the same manner as in Example 1 except that the disposition of the distribution holes of the final distribution plate of the used spinneret was changed from that in FIG. 4 to FIG. 5 so that the value of the minimum value $t_{min}$ of the thickness t of the polyester-based thermoplastic resin B covering the polyester-based thermoplastic resin A increased by 10 times, to obtain a core-sheath composite fiber constituted of the polyester-based thermoplastic resin A and the polyester-based thermoplastic resin B and having ($t_{min}/D$) of 0.20. The results are shown in Table 1.

Comparative Example 4

A composite fiber and a woven fabric were obtained in the same manner as in Example 1 except that a DY having an apparent thick/thin ratio ($D_{thick}/D_{thin}$) of 1.00 (i.e., a yarn having a uniform fiber diameter without a bulged portion (thick portion) of the composite fiber nor a converged portion (thin portion) of the composite fiber) was obtained at a draw ratio of 1.90 times in the drawing device at the drawing step. The results are shown in Table 1.

Example 4

A woven fabric was obtained in the same manner as in Example 1 except that the DY produced in Example 1 was further entangled and mixed with a polyethylene terephthalate fiber (74 dtex-48f) having an apparent thick/thin ratio ($D_{thick}/D_{thin}$) of 1.15 so as to be 42 mass % with an interlacing nozzle, to form a composite mixed-filament fiber, the warp density was 82 yarns/inch, and the weft density was 75 yarns/inch. The results are shown in Table 1.

Example 5

A composite fiber was produced in the same manner as in Example 1 except that a UY was produced at a spinning speed of 1400 m/min. As a result, partial fusion bonding occurred at the setting step of drawing, and thus a composite fiber and a woven fabric without fusion bonding were obtained at a set temperature of 120° C. The obtained woven fabric had a low elongation rate, but was excellent in texture and worsted-wool feeling. The results are shown in Table 1.

Example 6

A composite fiber and a woven fabric were obtained in the same manner as in Example 1 except that polyester having a weight average molecular weight of 20,000 obtained by copolymerizing isophthalic acid (IPA) with respect to an acid component in an amount of 10 mol % was used as the polyester-based thermoplastic resin A. The results are shown in Table 1.

TABLE 1

| | | Example 1 | Example 2 | Example 3 | Comparative Example 1 | Comparative Example 2 |
|---|---|---|---|---|---|---|
| Composite fiber | Weight average molecular weight (MA) of polyester-based thermoplastic resin A | 25000 | 25000 | 25000 | 15000 | 25000 |
| | Weight average molecular weight (MB) of polyester-based thermoplastic resin B | 15000 | 15000 | 15000 | 15000 | 15000 |

TABLE 1-continued

| | | | | | | |
|---|---|---|---|---|---|---|
| | $M_A - M_B$ | 10000 | 10000 | 10000 | 0 | 10000 |
| | Copolymerization component of thermoplastic resin A | | | | | |
| | Fiber cross-section | Eccentric core-sheath type | Eccentric core-sheath type | Eccentric core-sheath type | Eccentric core-sheath type | Side-by-side type |
| | Spinning speed (m/min) | 2600 | 2600 | 2600 | 2600 | 2600 |
| | Draw ratio | 1.50 | 1.30 | 1.40 | 1.50 | 1.50 |
| | Fineness (dtex) | 66.7 | 76.9 | 71.4 | 66.7 | 66.7 |
| | Number of filaments | 12 | 12 | 12 | 12 | 12 |
| | Yarn processing stability | Good | Good | Good | Good | Good |
| | Average fiber diameter Dave (μm) | 22.6 | 24.3 | 23.4 | 22.6 | 22.6 |
| | Apparent thick/thin ratio ($D_{thick}/D_{thin}$) | 1.40 | 1.25 | 1.30 | 1.40 | 1.40 |
| | $t_{min}/D$ | 0.020 | 0.020 | 0.020 | 0.020 | — |
| | $C_t/C$ | 0.40 | 0.40 | 0.40 | 0.40 | — |
| | Hysteresis loss rate | 57.7 | 63.0 | 60.2 | 45.9 | 57.2 |
| | LR1 | 1.38 | 1.15 | 1.25 | 1.37 | 1.38 |
| | LR2/LR1 | 1.95 | 1.28 | 1.49 | 1.00 | 1.63 |
| | Presence or absence of crack | Present over entire circumference | Present over entire circumference | Present over entire circumference | Present over entire circumference | Present around only half circumference |
| Filament combined with composite fiber | Material | | | | | |
| | Apparent thick/thin ratio ($D_{thick}/D_{thin}$) | | | | | |
| | Difference in fiber length (%) | | | | | |
| Woven/knitted fabric | Elongation rate (%) | 28.2 | 23.0 | 25.8 | 2.5 | 28.5 |
| | Texture | 4 | 4 | 4 | 2 | 2 |
| | Worsted-wool feeling | 4 | 4 | 4 | 2 | 2 |
| | Grainy feeling | 5 | 4 | 4 | 4 | 3 |
| Amount of fiber fragments (mg) | | 73.13 | 76.87 | 72.55 | 69.36 | 76.19 |

| | | Comparative Example 3 | Comparative Example 4 | Example 4 | Example 5 | Example 6 |
|---|---|---|---|---|---|---|
| Composite fiber | Weight average molecular weight (MA) of polyester-based thermoplastic resin A | 25000 | 25000 | 25000 | 25000 | 20000 |
| | Weight average molecular weight (MB) of polyester-based thermoplastic resin B | 15000 | 15000 | 15000 | 15000 | 15000 |
| | $M_A - M_B$ | 10000 | 10000 | 10000 | 10000 | 5000 |
| | Copolymerization component of thermoplastic resin A | | | | | IPA 10 mol % |
| | Fiber cross-section | Eccentric core-sheath type | Eccentric core-sheath type | Eccentric core-sheath type | Eccentric core-sheath type | Eccentric core-sheath type |
| | Spinning speed (m/min) | 2600 | 2600 | 2600 | 1400 | 2600 |
| | Draw ratio | 1.50 | 1.90 | 1.50 | 1.50 | 1.50 |
| | Fineness (dtex) | 66.7 | 52.6 | 66.7 | 66.7 | 66.7 |
| | Number of filaments | 12 | 12 | 12 | 12 | 12 |
| | Yarn processing stability | Good | Good | Good | Good at 120° C. set | Good |
| | Average fiber diameter Dave (μm) | 22.6 | 20.1 | 22.6 | 22.6 | 22.6 |
| | Apparent thick/thin ratio ($D_{thick}/D_{thin}$) | 1.40 | 1.00 | 1.40 | 1.40 | 1.40 |
| | $t_{min}/D$ | 0.200 | 0.020 | 0.020 | 0.020 | 0.020 |
| | $C_t/C$ | 0.20 | 0.40 | 0.40 | 0.40 | 0.40 |
| | Hysteresis loss rate | 58.0 | 39.7 | 64.2 | 72.7 | 78.4 |
| | LR1 | 1.38 | — | 1.38 | 1.38 | 1.38 |
| | LR2/LR1 | 1.09 | — | 1.63 | 1.15 | 1.95 |
| | Presence or absence of crack | Present over entire circumference | Absent | Present over entire circumference | Partially cut | Present over entire circumference |
| Filament combined with composite fiber | Material | | | PET | | |
| | Apparent thick/thin ratio ($D_{thick}/D_{thin}$) | | | 1.15 | | |
| | Difference in fiber length (%) | | | 23 | | |
| Woven/knitted fabric | Elongation rate (%) | 12.3 | 29.0 | 27.9 | 16.1 | 28.0 |
| | Texture | 3 | 2 | 5 | 3 | 4 |
| | Worsted-wool feeling | 3 | 2 | 5 | 3 | 4 |
| | Grainy feeling | 4 | 2 | 5 | 3 | 4 |
| Amount of fiber fragments (mg) | | 80.62 | 66.09 | 86.38 | 206.98 | 109.23 |

DESCRIPTION OF REFERENCE SIGNS

1: Polyester-based thermoplastic resin A
2: Polyester-based thermoplastic resin B
3: Composite fiber
4: Crack
5: Partially oriented yarn (POY)
6: Guide
7: First feed roller
8: Hot pin
9: Second feed roller
10: Heater
11: Third feed roller
12: Composite fiber having thick/thin ratio
13: Winding unit
14: Distribution holes of polyester-based thermoplastic resin A among distribution holes in final distribution plate
15: Distribution holes of polyester-based thermoplastic resin B among distribution holes in final distribution plate
16: Thickness t of polyester-based thermoplastic resin B covering polyester-based thermoplastic resin A

The invention claimed is:

1. A composite fiber comprising a polyester-based thermoplastic resin A and a polyester-based thermoplastic resin B, and satisfying following requirements (1) to (4):

(1) a difference ($M_A$–$M_B$) between a weight average molecular weight $M_A$ of the polyester-based thermoplastic resin A and a weight average molecular weight $M_B$ of the polyester-based thermoplastic resin B is 2,000 to 15,000;

(2) in the composite fiber, an apparent thick/thin ratio ($D_{thick}/D_{thin}$) of the composite fiber is 1.25 to 3.00;

(3) in a cross-section of the composite fiber, the polyester-based thermoplastic resin B covers the polyester-based thermoplastic resin A, and a ratio ($t_{min}/D$) of a minimum value $t_{min}$ of a thickness t of the polyester-based thermoplastic resin B to a fiber diameter D of the composite fiber is 0.01 to 0.10; and (4) in the cross-section of the composite fiber, a circumferential length $C_t$ of a portion where the thickness t satisfies $1.00t_{min} \leq t \leq 1.05t_{min}$ is $C_t \geq 0.33C$ with respect to an entire circumferential length C of the composite fiber.

2. The composite fiber according to claim 1, wherein a hysteresis loss rate during elongation recovery at a maximum load of 0.5 cN/dtex of the composite fiber is 0 to 70%.

3. The composite fiber according to claim 1, wherein a thin/thick length ratio LR1 (L2/L1) of a thin portion length (L2) to a thick portion length (L1) in a fiber axis direction at a measurement load of 0.00166 cN/dtex of the composite fiber is 0.90 to 1.40, and a ratio (LR2/LR1) of a thin/thick length ratio LR2 at a measurement load of 0.11 cN/dtex to the thin/thick length ratio LR1 at the measurement load of 0.00166 cN/dtex is 1.20 to 2.10.

4. A composite fiber comprising a polyester-based thermoplastic resin A and a polyester-based thermoplastic resin B, and satisfying following requirements (1) to (4):

(1) a difference ($M_A$–$M_B$) between a weight average molecular weight $M_A$ of the polyester-based thermoplastic resin A and a weight average molecular weight $M_B$ of the polyester-based thermoplastic resin B is 2,000 to 15,000;

(2) in the composite fiber, an apparent thick/thin ratio ($D_{thick}/D_{thin}$) of the composite fiber is 1.05 to 3.00;

(3) in a cross-section of the composite fiber, the polyester-based thermoplastic resin B covers the polyester-based thermoplastic resin A, and a ratio ($t_{min}/D$) of a minimum value $t_{min}$ of a thickness t of the polyester-based thermoplastic resin B to a fiber diameter D of the composite fiber is 0.01 to 0.10; and (4) in the cross-section of the composite fiber, a circumferential length $C_t$ of a portion where the thickness t satisfies $1.00t_{min} \leq t \leq 1.05t_{min}$ is $C_t \geq 0.33C$ with respect to an entire circumferential length C of the composite fiber, wherein the composite fiber has a crack on a surface of the composite fiber at least in a portion where an apparent thickness of the composite fiber has a large fiber diameter ($D_{thick}$).

5. A composite mixed-filament fiber, wherein at least another type of filament is further combined with the composite fiber according to claim 1.

6. A woven/knitted fabric comprising the composite fiber according to claim 1 at least in a portion.

7. A woven/knitted fabric comprising the composite mixed-filament fiber according to claim 5 at least in a portion.

8. A garment comprising the composite fiber according to claim 1 at least in a portion.

9. A garment comprising the composite mixed-filament fiber according to claim 5 at least in a portion.

10. A garment comprising the woven/knitted fabric according to claim 6 at least in a portion.

* * * * *